United States Patent [19]

Fredd

[11] 4,252,143

[45] Feb. 24, 1981

[54] ACTUATOR

[75] Inventor: John V. Fredd, Dallas, Tex.

[73] Assignee: Otis Engineering Corporation, Dallas, Tex.

[21] Appl. No.: 44,046

[22] Filed: May 31, 1979

[51] Int. Cl.[3] ..... E21B 43/12

[52] U.S. Cl. ..... 137/115; 74/2; 74/110; 137/467; 166/323; 185/37; 251/66; 251/75

[58] Field of Search ..... 74/2, 110; 137/115, 137/467, 494, 507; 166/321, 323; 185/37; 251/75, 66, 74

[56] References Cited

U.S. PATENT DOCUMENTS 3,889,751 6/1975 Peters ..... 251/75 X

FOREIGN PATENT DOCUMENTS 766016 1/1957 United Kingdom ..... 251/75

*Primary Examiner*—Robert G. Nilson

*Attorney, Agent, or Firm*—Vinson & Elkins

[57] ABSTRACT

There is disclosed a testing system employing a circulating tool, a cushion valve, a seal unit packer with a foot sleeve, and a landing nipple with a transducer fitting. This system permits running a packer with a foot sleeve and transducer fitting and landing it in the well, and subsequently running a tubing with a circulating tool and cushion valve to land in the seal unit. Thereafter a transducer may be run on a wireline.

7 Claims, 6 Drawing Figures

ACTUATOR

Figure 1:
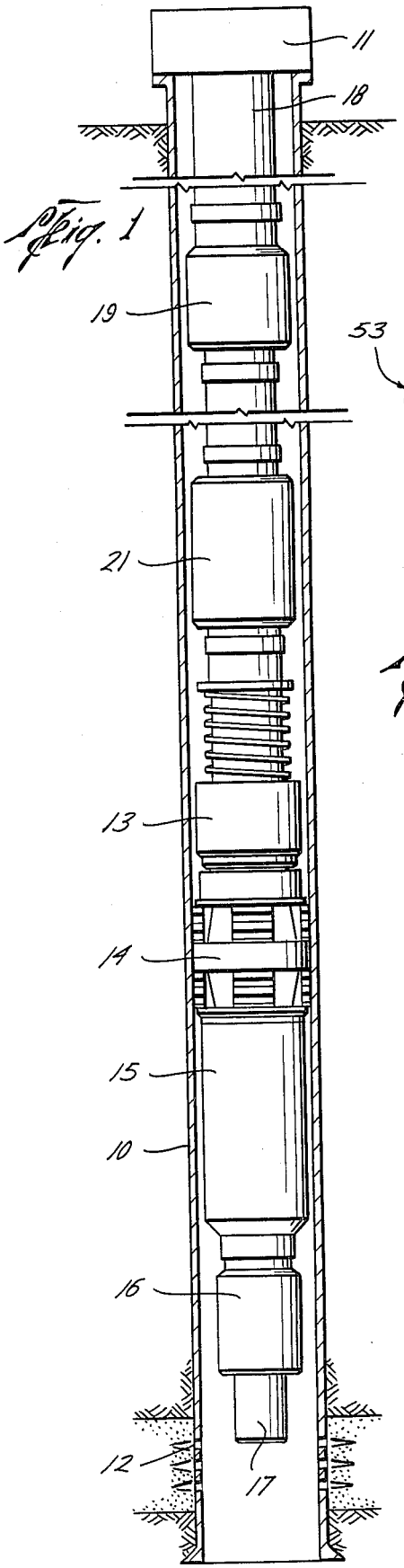

The disclosure includes a particular circulating tool employing multiple escapements in which the circulating tool when closed is urged to closed position and when open is urged to open position.

This invention relates to actuators. In one form it relates to a valve and actuator and particularly to a circulating valve for use in well testing.

In the testing of wells it is frequently desirable to be able to selectively produce the well through the tubing and to circulate fluid between the casing-tubing annulus and the tubing in the area above the packer. Desirably this is done with a circulating valve provided in the tubing. In accordance with this invention it is preferred that the circulating valve be operable in response to pressure.

It is an object of this invention to provide an actuator for a device such as a circulating valve which is pressure responsive and when in one position has means for resiliently urging the actuator system to said one position and when in another position has means urging the system to the other position.

Another object is to provide a circulating valve which when closed is resiliently urged to closed position and when open is resiliently urged to open position.

Another object is to provide an actuator or a valve with an actuator member in which when the actuator member is in one position, a resilient means in compression urges the actuator member toward said one position and when the actuator is in the other position, such as valve open position, the resilient means urges the actuator toward such open position.

Another object is to provide a valve in combination with an actuator system in which a resilient means urges the valve toward closed position when it is closed and toward open position when it is open and in movement between closed and open position operates a separate control system.

Another object is to provide a slide valve with a shutter to protect seals and an actuator which resiliently urges the valve to closed position when the valve is closed and to open position when the valve is opened and in which movement of the valve between open and closed position operates the shutter.

Another object is to provide a valve as in the preceding object with means for returning it to closed position after it has been opened.

Other objects, features and advantages of this invention will be apparent from the drawings, the specification and the claims.

IN THE DRAWINGS

Figure 5:
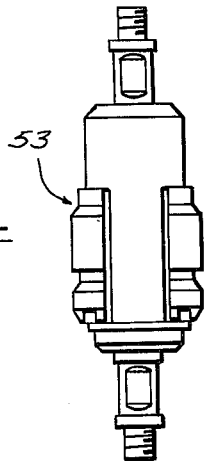
Figure 6:
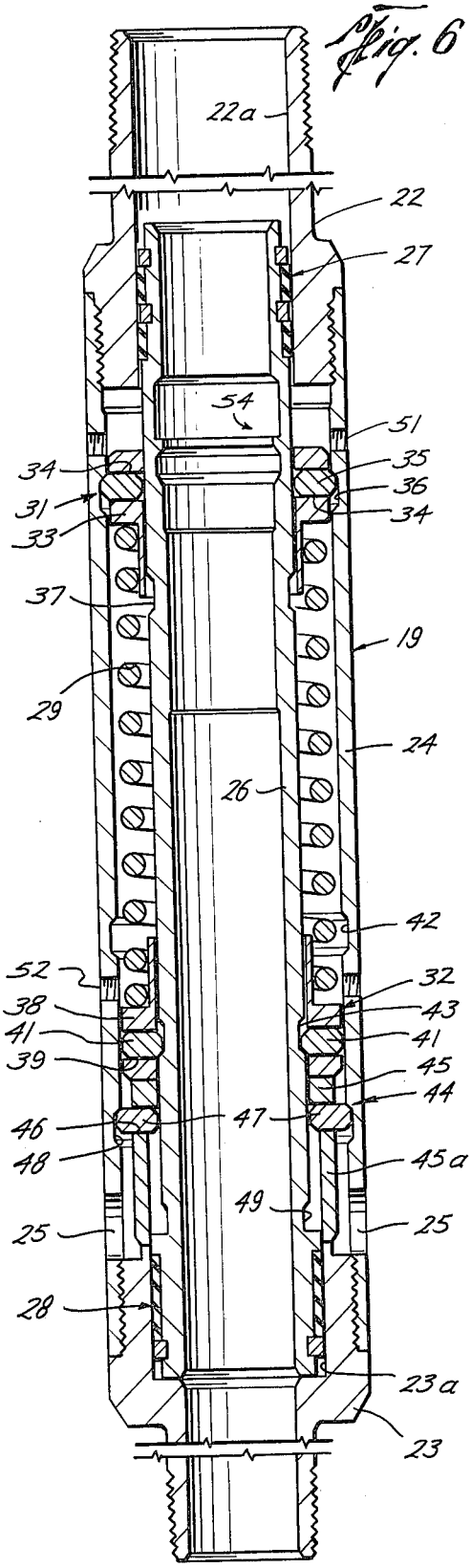
Figure 4:
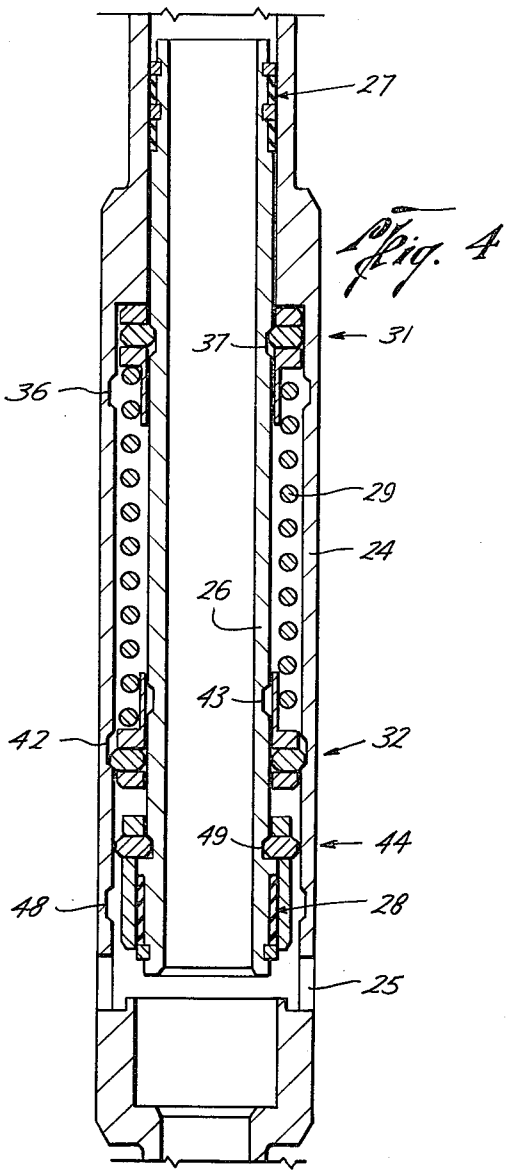
Figure 3:
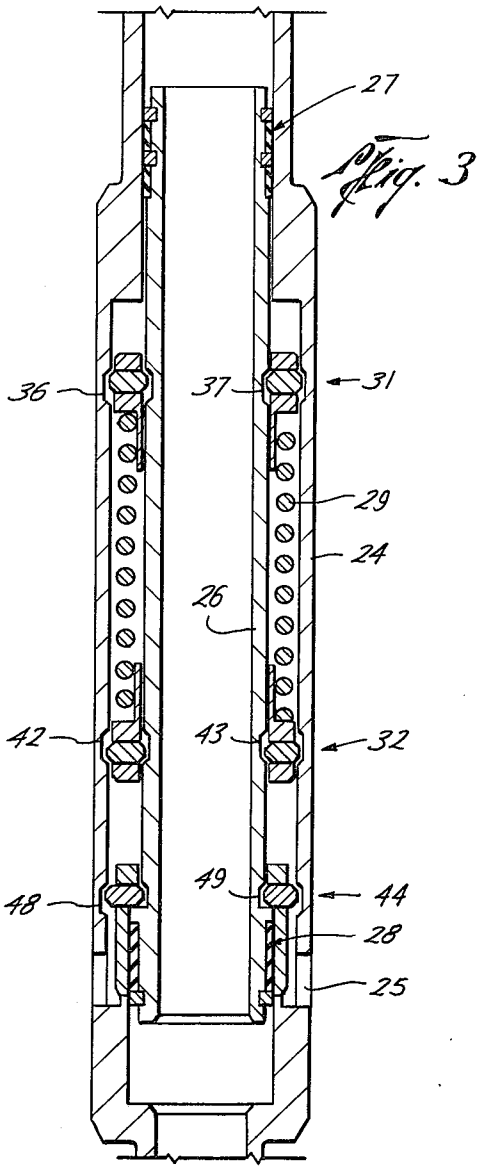
Figure 2:
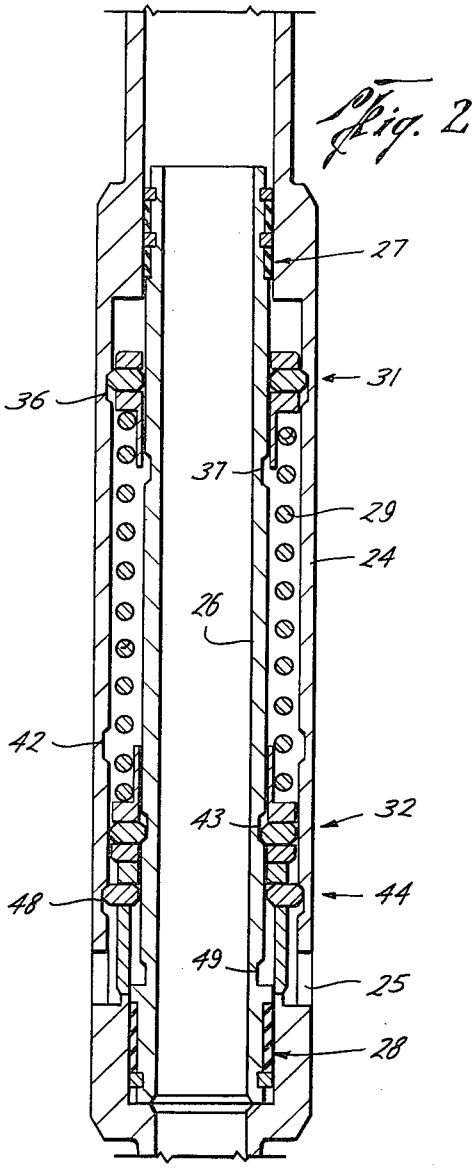

In the Drawings wherein an illustrative embodiment of this invention is shown, FIG. 1 is a schematic illustration of a well test installation employing the circulating valve of this invention;

FIGS. 2, 3 and 4 are schematic illustrations of the operation of the actuator of this invention showing in FIG. 2 the valve in closed position, in FIG. 3 the actuator of the valve moved to transition position in which the several escapements are released from the housing or actuator as shown in FIG. 2 preparatory to engaging the other of the actuator and housing, and in FIG. 4 the valve in full open position;

FIG. 5 is a view in elevation of a positioning tool for re-closing the valve once it has been opened; and FIG. 6 is a view in section through the preferred form of circulating tool of this invention.

Referring first to FIG. 1, there is shown a well having a casing 10 and standard surface equipment 11 at the top of the well. The casing and well are shown to be perforated at 12 into the formation to be tested.

Within the well there is an assembly made up of packer 14, foot sleeve 15, landing nipple 16, and transducer fitting 17 which are preferably run into the well and landed in place in a preliminary operation as by conventional wireline techniques.

The test or production tubing 18 is shown to have a circulating valve 19 therein in accordance with this invention and a cushion valve 21 and seal unit 13 with the tailpipe of the seal unit shown in sealing engagement with the packer 14. During running of the tubing 18 the cushion valve may be utilized to support a column of fluid in the tubing which is released by opening of the cushion valve when the string engages the packer 14.

The packer 14 packs off the producing formation and the foot sleeve 15 is provided with suitable control mechanism to control the flow through the foot sleeve and into the tubing. The landing nipple and transducer fitting provide for landing a transducer such as a pressure sensing device within the fitting to sense the pressure in the casing and below the packer. With this assembly static pressure in the formation below the packer as well as build-up pressure can be recorded or transmitted to the surface through a suitable electric line and flow can be provided through the foot sleeve to test the flow characteristics of the well.

During testing operation the circulating tool valve 19 is normally closed. Conditions may arise, however, when it is desirable or imperative to provide for circulation between the casing-tubing annulus and the tubing.

In accordance with this invention the circulating valve 19 is one which may be quickly and readily opened to provide for such circulation.

The actuator of this invention may be utilized in any desired setting. It was developed, however, to form a part of the circulating valve 19 and its operation and construction will be explained in conjunction with its use as a part of a circulating valve. The invention, however, is not restricted to the use of an actuator with a valve as it is contemplated that the actuator and its escapement mechanisms could be used in any other desired structure.

Referring first to FIG. 6, the circulating valve has a housing made up of the upper sub 22 and the lower sub 23 joined together by a suitable sleeve-like housing member 24. At its lower end the housing is provided with a plurality of circumferentially arranged ports 25 to permit flow through the housing.

A tubular actuator 26 is reciprocal within the housing and has at its upper and lower extremity packing systems 27 and 28. The upper packing system 27 seals with the bore **22*a* through the upper sub and the lower packing system 28 is in sealing engagement with the counterbore 23*a* within the lower sub 23. With the actuator in the closed position as shown in FIG. 6, the two seal systems 27 and 28 prevent flow through the ports 25** and maintain the integrity of the tubing in which the circulating valve is placed.

It is apparent from FIG. 6 that the preferred form of valve is a sleeve valve in which the lower end of the actuator 26 which carries the packing 28 is a sleeve valve member which when raised uncovers the ports 25 and permits fluid communication between the interior and the exterior of the housing.

The outer diameter of the seal system 28 is greater than the outer diameter of the seal system 27 and thus an increase in pressure within the circulating valve is effective on the difference between these two areas to urge the actuator tube 26 toward valve opening position.

A resilient means such as spring 29 is held in compression between an upper escapement assembly 31 and an intermediate escapement assembly 32. This resilient means 29 is always in compression and when the valve is in the closed position shown in FIG. 6 urges the valve to closed position. When the valve is in open position the resilient means 29 also urges the valve member to open position.

The upper escapement 31 includes a lug carrier 33 having radial holes 34 at circumferentially spaced points thereabout in which lugs 35 are carried. The lugs 35 cooperate with an upper housing groove 36 and an upper actuator groove 37 in the housing and actuator, respectively.

In like manner the intermediate escapement includes the lug carrier 38 having radial holes 39 therethrough in which lugs 41 are carried. The lugs 41 alternately cooperate with the groove 42 in the housing and the groove 43 in the actuator. A lower escapement indicated at 44 is provided for controlling a shutter. The escapement includes the lug carrier 45, the lower portion 45*a* being the shutter. Circumferentially spaced holes 46 receive the lugs 47. The lugs 47 cooperate with the groove 48 in the housing and the groove 49 in the actuator.

A plurality of upper and lower threaded holes 51 and 52, respectively, are provided in the housing. These holes are provided in circumferentially spaced points and receive lock studs to lock the spring system in compression during assembly of the valve. Suitable studs introduced through the holes 51 bear against the upper end of the lug carrier 33 and hold it in position with the dogs 35 in the grooves 36. Then a suitable tool is introduced into the housing 19 and spring 29 compressed until the lug carrier 38 is above the holes 52 and studs are run into the holes 52 to bear against the bottom of the lug carrier and hold the spring in compression. The shutter lug carrier 45 with the lugs 47 can then be dropped into the housing and the actuator inserted into the housing from the bottom side and moved to a position in which the valve is open and the grooves 37, 43 and 49 positioned underneath the three sets of lugs. If the valve actuator has not been dressed with packing 27 and 28 it can be dressed at this time. Thereafter, the upper and lower subs 22 and 23 are threaded to the sleeve housing 24 to complete the assembly. Removal of the supporting bolts from the holes 52 will permit the actuator to move downwardly under the force of spring 29 to position all of the parts in the position shown in FIG. 6. At this time the bolts may be removed from the holes 51 and the valve is ready for use.

Reference is made to FIGS. 2, 3 and 4 to show the operation of the valve. In FIG. 2 the valve is schematically shown in its closed position with the lugs of the upper escapement 31 engaged in the groove in the housing and the lugs of the intermediate escapement 32 engaged in the grooves in the actuator. As the spring 29 is in compression, the actuator is urged downwardly relative to the housing to hold the valve in closed position. In this position the lugs and the shutter escapement 44 are engaged with the housing to hold the shutter in the down position.

The intermediate position of the actuator is shown in FIG. 3. The application of pressure internally of the valve acts on the differential between the two seals and moves the actuator in an upward direction. It will be noted that in the FIG. 3 position the shutter is still in place over the ports 25 but the actuator has moved up to a position in which the lower seal assembly 28 is above the lower end of the shutter. This protects the seal assembly as it moves out of the lower sub 23 to prevent damage to the seal assembly by pressure flowing between the lower end of the shutter and the upper end of the lower sub 23. As the shutter is still in closed position it will act as a rough seal to limit flow through the ports 25 and permit the elevated pressure to be maintained within the valve.

It will be noted that the width of the several lugs is substantially less than the width dimension of the several grooves with which they cooperate. Thus the spring 29 will tend to urge the lugs of the upper and intermediate escapements 31 and 32 away from each other. As the actuator 26 continues its upward movement it urges the dogs 41 of the intermediate escapement 32 outwardly and the spring 29 seats these dogs in groove 42 in the housing. At about the same time the groove 37 moves slightly above the groove 36 of the upper escapement assembly and forces the dogs 35 into the groove 37 on the actuator. At this time the spring force is applied in a direction to urge the actuator upwardly as viewed in the drawings to augment the high pressure in the tubing and drive the valve to full open position.

This relationship is shown in FIG. 3 and it will be noted that the upper escapement shows the lugs in the groove in the actuator and the intermediate escapement shows the lugs in the groove in the housing.

As the upper and intermediate escapements were making their transition between the housing and actuator the lower escapement controlling the shutter likewise made a transistion in which the lugs moved out of the grooves in the housing and moved into the grooves in the actuator as shown in FIG. 4. When this occurred the lower escapement being latched to the actuator moved up with the actuator to move the shutter into an out of the way position to fully expose the ports 25 and provide a full open flow through the ports 25.

While the operation of the several escapements has been explained as happening substantially simultaneously it will be apparent that this is not necessary and the escapements could transfer the lugs between the housing and actuator in sequential operation.

After the reason for circulating through the circulating valve has been corrected, the circulating valve may be closed if desired. For this purpose a conventional positioning tool indicated generally at 53 having a lug profile, which is a mirror image of the profile indicated generally at 54, within the actuator 26 is utilized. The positioning tool is a conventional piece of equipment known as the type B Otis Positioning Tool. See *The Composite Catalog of Oil Field Services and Equipment* for the years 1974–1975, page 3968. The positioning tool will be run into the hole preferably with conventional pump down piston thereabove and will latch into the profile 54 within the actuator 26. The tubing will then be pressured up to shift the actuator downwardly returning the tool to the position shown in FIG. 2.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. Apparatus comprising:

a housing, an actuator for shifting a part, means for moving said actuator, resilient means, first and second escapement means cooperable with said housing and actuator and confining said resilient means in compression, said first escapement means selectively operable to limit movement of one end of the resilient means relative to the housing or the actuator, said second escapement means selectively operable to limit movement of the other end of the resilient means relative to the housing or actuator, said first and second escapements alternately securing opposite ends of the resilient means to said housing and actuator in response to movement of said actuator, whereby the resilient means alternately urges the actuator in opposite directions, and a third escapement cooperable with the housing and actuator, said third escapement in one position securing a second part to the actuator and in another position securing the second part to the housing.

2. A valve comprising:

a housing having a flow way therethrough, a valve member controlling flow through said flow way, an actuator controlling movement of said valve member between open and closed positions, means for moving said actuator, resilient means, first and second escapement means cooperable with said housing and actuator and confining said resilient means in compression, said first escapement means selectively operable to limit movement of one end of the resilient means relative to the housing or the actuator, said second escapement means selectively operable to limit movement of the other end of the resilient means relative to the housing or the actuator, said first and second escapement means alternately securing opposite ends of the resilient means to said housing and actuator in response to movement of said actuator, whereby when the valve is closed, the resilient means urges the valve member to closed position and when the valve is open, urges the valve member to open position, and a third escapement cooperable with the housing and actuator, said third escapement in one position securing a shutter to the actuator and in another position securing the shutter to the housing.

3. Apparatus according claims 1 or 2 in which the means for moving said actuator in one direction is a pressure responsive surface and in the other direction is a recess in said actuator in combination with a positioning tool which engages in said recess and shifts said actuator in said other direction. Please add the following claims:

4. A valve comprising, a tubular housing having a bore therethrough and means at each end for securing the valve in a tubing string, said housing having port means intermediate its ends, a tubular actuator is said housing mounted for axial reciprocation, spaced resilient seal means carried by said actuator, one of said seal means in engagement with said bore in all positions of said actuator and having a smaller effective area than the other of said seal means to provide a pressure responsive area, the other of said seal means in one position of said actuator engaging said housing bore and in the other position disengaging said housing bore to control flow through said port means, resilient means, first and second escapement means cooperable with said housing and actuator and confining said resilient means in compression, said first escapement means selectively operable to limit movement of one end of the resilient means relative to the housing or the actuator, said second escapement means selectively operable to limit movement of the other end of the resilient means relative to the housing or the actuator, said first and second escapement means alternatively securing opposite ends of the resilient means to said housing and actuator in response to movement of said actuator, whereby when the valve is closed, the resilient means urges the valve member to closed position.

5. The valve of claim 4 in which said actuator has an internal annular recess therein and a positioning tool engaged in said recess for shifting said actuator to closed position.

6. The valve of claim 4 wherein a third escapement means cooperable with the housing and actuator is provided, said third escapement means in one position securing a shuter to the actuator and in another position securing the shutter to the housing.

7. The valve of claim 4 wherein a third escapement means cooperable with the housing and actuator is provided, said third escapement means in one position securing a shutter to the actuator and in another position securing the shutter to the housing, said third escapement means changing from said other position to said one position at approximately the same time that the first and second escapement means alternate the securement of the ends of the resilient means to the housing and actuator.

* * * * *